United States Patent [19]

Ballard et al.

[11] Patent Number: 4,850,545

[45] Date of Patent: Jul. 25, 1989

[54] APPARATUS FOR WINDING FILM

[75] Inventors: Raymond M. Ballard, Lancaster; Albert W. Forrest, Jr., Chillicothe, both of Ohio

[73] Assignee: E. I. Du Pont de Nemours and Company, Wilmington, Del.

[21] Appl. No.: 559,375

[22] Filed: Dec. 8, 1983

[51] Int. Cl.[4] ..... B65H 18/14; B65H 18/26

[52] U.S. Cl. ..... 242/67.1 R

[58] Field of Search ..... 242/67.1 R; 75.1, 75.2, 242/76, 55; 26/104; 28/196, 197; 226/19, 192, 199

[56] References Cited

U.S. PATENT DOCUMENTS

| | | | |
|---|---|---|---|
| 3,279,718 | 10/1966 | Arterton et al. | 242/67.1 R |
| 3,357,073 | 12/1967 | Eury | 26/104 |
| 3,410,499 | 11/1968 | Schmidt | 242/67.1 R |
| 3,433,429 | 3/1969 | Schnitzspahn | 242/65 |
| 3,491,655 | 1/1970 | Brafford | 226/191 |
| 3,602,448 | 8/1971 | Muensterer | 242/67.1 X |
| 3,752,378 | 8/1973 | Scheffel | 226/191 |
| 3,756,527 | 9/1973 | Collins et al. | 242/56.2 |
| 3,854,646 | 12/1974 | Dorfel | 226/191 |
| 4,193,559 | 3/1980 | Ballard | 242/67.1 R |
| 4,365,767 | 12/1982 | Benthimere | 242/75.2 X |

FOREIGN PATENT DOCUMENTS

| | | | |
|---|---|---|---|
| 814172 | 6/1969 | Canada . | |
| 0122134 | 10/1984 | European Pat. Off. . | |
| 1126696 | 3/1962 | Fed. Rep. of Germany | 242/67.1 R |
| 639527 | 6/1928 | France . | |
| 2210240 | 7/1974 | France . | |
| 54-48192 | 4/1979 | Japan . | |
| 55-155747 | 11/1980 | Japan . | |
| 4217781 | 9/1988 | Japan . | |
| 1091967 | 11/1967 | United Kingdom . | |

OTHER PUBLICATIONS

Kern, "Mica-Bow Expander and Spreader Rolls", Oct. 29, 1976.

*Primary Examiner*—Harvey C. Hornsby
*Assistant Examiner*—Scott J. Haugland

[57] ABSTRACT

An apparatus for winding rolls of thin, wide film. High quality rolls free from circumferential ridges are wound by pressing a segmented bowed roll against a winding roll.

4 Claims, 6 Drawing Sheets

FIG. 5
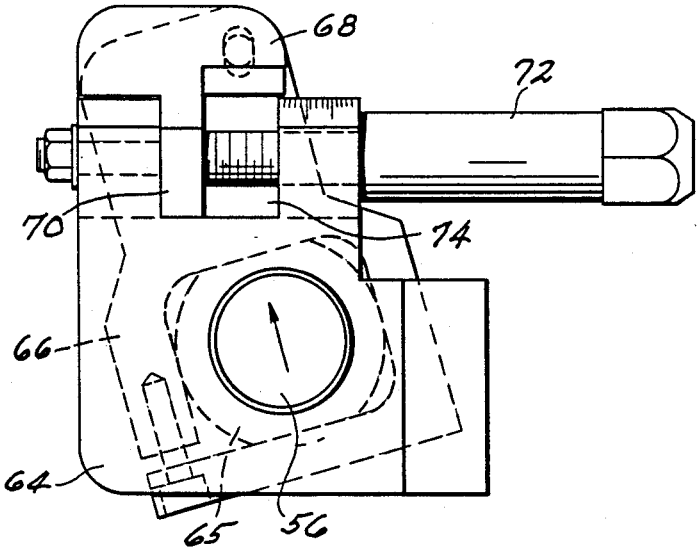
FIG. 3
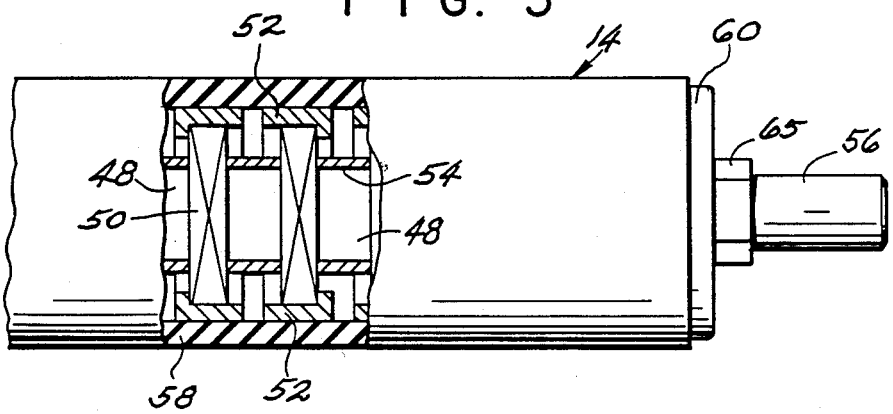
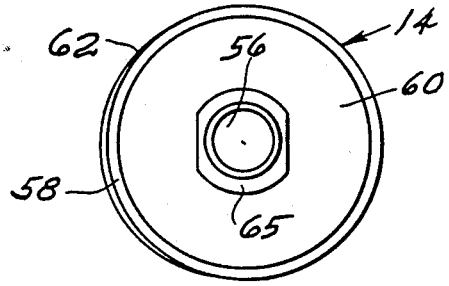
FIG. 4

APPARATUS FOR WINDING FILM

BACKGROUND

This invention relates generally to the production of film and, more particularly, to the winding of thin film into rolls of high quality.

Equipment for winding rolls from a continuous length of film is available and in use. It is known, for example, that a roll can be wound by advancing a thin, wide film to a driven roll and then pressing the film with a straight lay-on roll. As the winding roll builds, machine direction (MD) tension in inner, subsurface wraps is relaxed but there is no opportunity for lateral expansion of each wrap to its full width. As a consequence, MD ridges are formed by a buckling phenomenon. These ridges become set and present difficulties in achieving uniformity in subsequent coating, metallizing and laminating steps.

SUMMARY

The above and other defects and difficulties have been avoided with an apparatus which has a driven winding roll to which a film is advanced and against which a segmented bowed lay-on roll is pressed. The bowed roll is a follower.

DRAWINGS

FIGS. 3 and 4 are elevational and end views, respectively, of the bowed lay-on roll shown in FIGS. 1 and 2.

FIG. 5 is an enlarged view of the bow-adjusting device shown in FIG. 1.

FIG. 7 is taken on line VII—VII in FIG. 6.

DESCRIPTION

Figure 1:
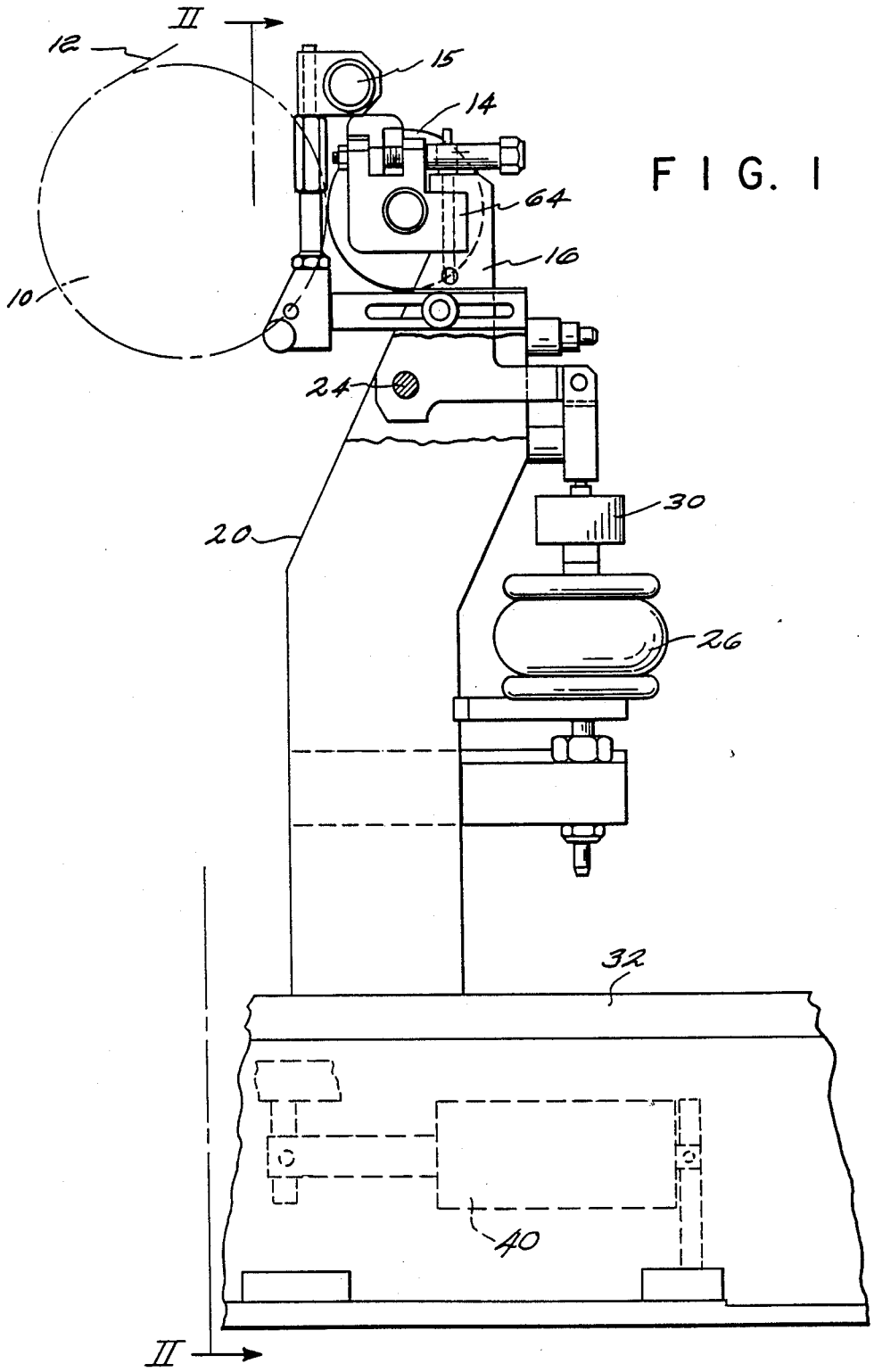
FIG. 1 is an end view of the film-winding apparatus of the present invention.

The embodiment shown in FIGS. 1–5 includes a driven mandrel or core 10 on which a mill roll of thin, wide film 12 is wound. The film 12 is pressed and laid on the winding roll by a bowed roll 14 located substantially beyond the point of tangency between film 12 and the winding roll. There is a static eliminator 15 above the nip between core 10 and roll 14. Roll 14 is mounted between bell-cranks 16, 18 and the latter are pivotally attached to pedestals 20, 22. The pivot pin for bell-crank 16 is shown at 24 in FIG. 1. Pressure is applied to the bell-cranks 16, 18 by air springs 26, 28 through load cells 30, 31. Pedestals 20, 22 travel toward and away from core 10 on carriages 32, 33.

Figure 2:
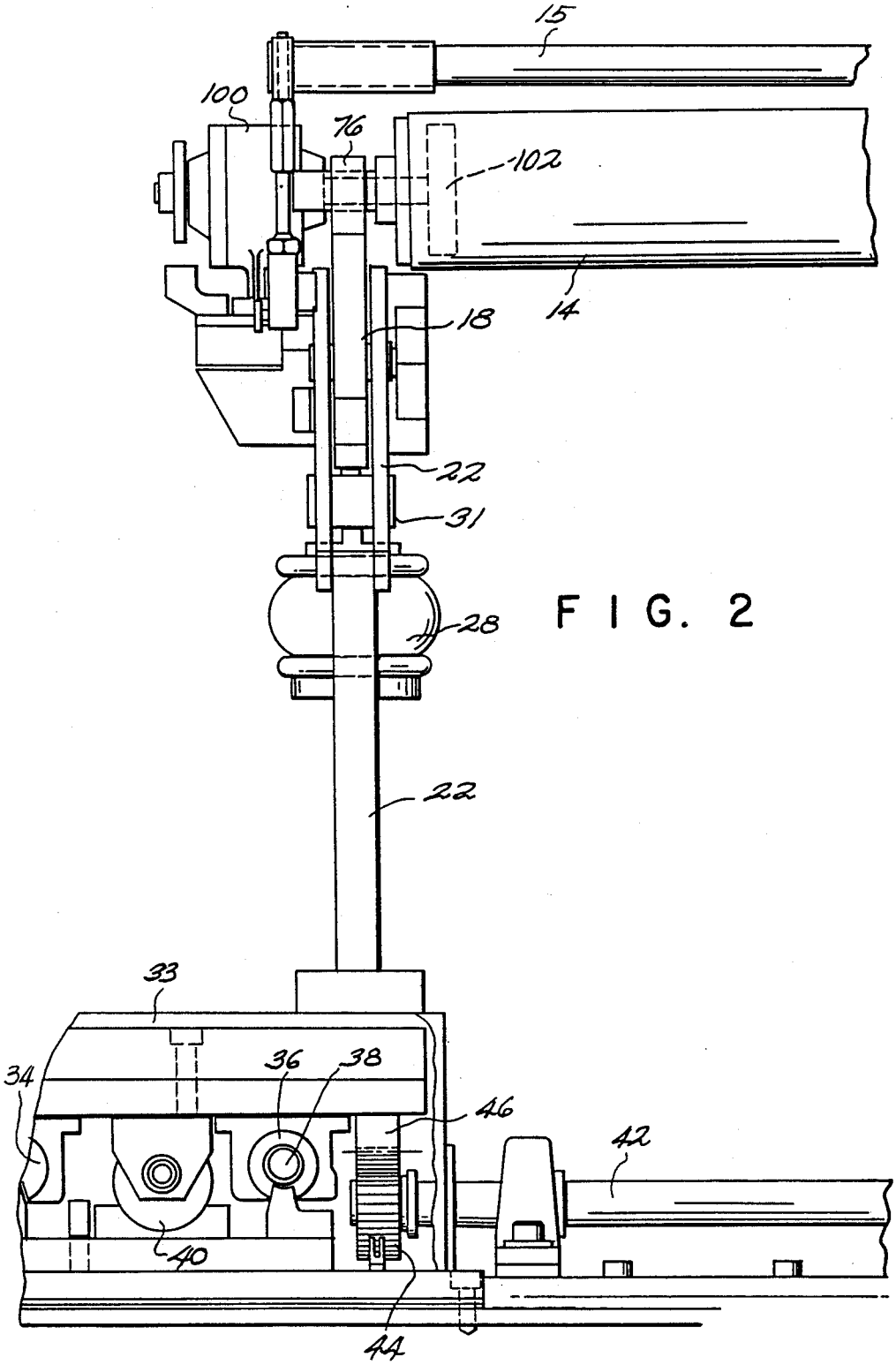
FIG. 2 is a fragmentary, elevational view taken in the direction of line II—II in FIG. 1.

In FIG. 2, the cover for the carriage 33 has been broken away to show spaced bushings 34, 36, each slidable on a fixed shaft 38. Between the bushings 34, 36, there is a piston-cylinder assembly 40. The carriage 32 (FIG. 1.) beneath pedestal 20 also includes bushings on fixed shafts and a piston-cylinder assembly 40. Assemblies 40 provide the force for moving the carriages linearly with respect to the winding roll and for loading the bowed roll 14 against the winding roll. Movement of the reciprocatable carriages is synchronized by a shaft 42 which carries a pinion 44 at each of its ends.

Each pinion 44 engages a rack 46 which is fixed to a carriage.

As shown in FIG. 3, bowed roll 14 has a shaft 48 which carries a plurality of roller bearings 50. The outer race of each bearing 50 is the mount for an annular segment 52. The proper spacing between adjacent bearings is maintained by rings 54. At each end, shaft 48 is provided with opposed flats and a stub 56. Fitted over segments 52, there is a sleeve or cover 58 of synthetic rubber. Caps 60 are attached to the end segments 52 to retain sleeve 58. Thus, sleeve 58 and segments 52 are freely rotatable on shaft 48. Because of the spaces between segments 52 and the resilience of sleeve 58, a slight bow in shaft 48 causes a similar bow in the exterior of the roll, as shown at 62 in FIG. 4. The high point of the bow is, of course, at the center of the roll 14 which will be referred to herein as a segmented, bowed lay-on roll (BLOR).

Referring to FIGS. 1, 3 and 5, the stub 56 at one end of BLOR 14 is supported by a mounting block 64 which is attached at the upper end of bell-crank 16. A fitting 65 which is machined on shaft 48 and provided with the opposed flats is engaged by a clamp 66 and clamp 66 is keyed to a lug 68 by the dowel pin and slot shown in FIG. 5. Lug 68 has a dependent ear 70 which is provided with an internally threaded passage for the threaded, intermediate length of a shaft 72. Rotation of shaft 72 moves ear 70 in slot 74 in block 64. In this manner, the toe-in angle of the bow in BLOR 14 toward the winding roll is adjusted. The stub 56 at the other end of the BLOR 14 is supported by a block 76 (FIG. 2) at the upper end of bell-crank 18. Blocks 64, 76 and the bell-cranks 16, 18 provide a mount for the BLOR.

With the ear 70 at the end of the slot 74, as shown in FIGS. 1 and 5, the plane of the bow in BLOR 14 is oriented at a maximum toe-in angle of about 15° from a vertical plane through the axis of stubs 56. The bow plane is in that vertical plane when shaft 72 is rotated to move ear 70 to the other end of slot 74. Adjustment of the bow plane compensates for deflection of bowed shaft 48 as a package is wound and distributes the nip force more uniformly.

When a full roll of film 12 has been wound, assemblies 40 are actuated to move the carriages and BLOR 14 away from it. Then, in the usual manner (e.g., see the turret type windup disclosed in U.S. Pat. No, 3,756,527 to Collins et al.), core 10 is swung away and replaced by an empty core 10 to which advancing film 12 is adhered after having been cut. Before moving BLOR 14 back into engagement with the driven core 10, an air motor 100 (FIG. 2) is swung to a position where a coupled wheel 102 engages BLOR 14. In this manner, BLOR 14 is brought to a surface speed equal to the speed of advance for film 12. When the transfer to the new core 10 is accomplished, motor 100 and wheel 102 are swung away from BLOR 14 and stopped.

As a roll of film is wound, the desired nip loading force is applied to BLOR 14 by assemblies 40 and that force is kept at a uniform level across the width of the film by adjustments of the air pressure supplied to air springs 26, 28, as monitored by load cells 30, 31. Enough nip loading force is applied to press or lay the film on the winding roll 10. With the BLOR 14 engaging the winding roll as a follower, it is not only possible to avoid ridges but, also, to do so at normal and higher than normal speeds of advance for film 12.

In tests of the apparatus, rolls 14 having diameters of 3½ and 4½ inches and bows of 0.2–0.4 inch were used to wind ridge free rolls of thin gauge, polyester films having widths ranging from 50 to 64 inches. One particular roll a modified (Model No. SD-450-6603, Fife Corp., Oklahoma City, Okla.) has a diameter of 4½ inches, a face sixty-six inches in length and a bow of 0.3 inch. The plane of the bow in the rolls 14 was adjusted to approximately 10° from a vertical plane at the start of each winding roll.

Figure 6:
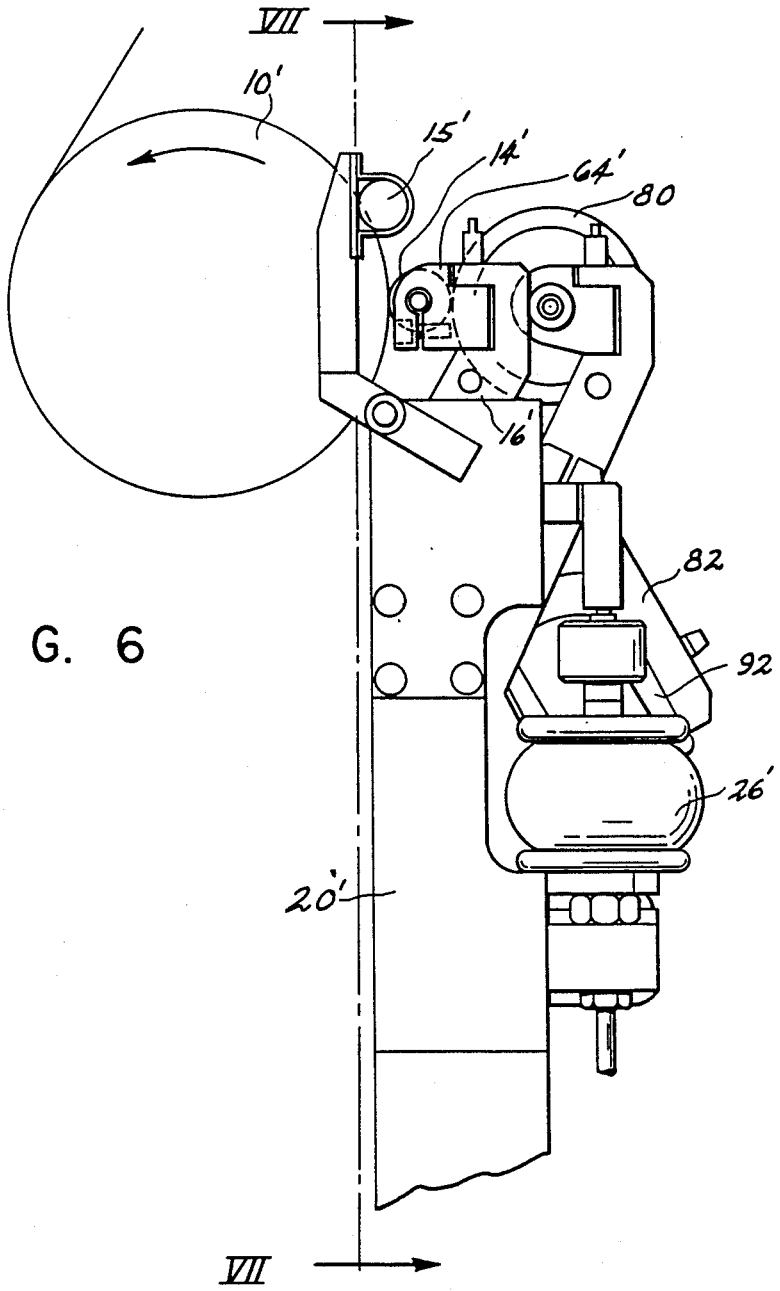
FIGS. 6 and 7 are end and elevational views, respectively, of a modification of the film-winding apparatus.
Figure 7:
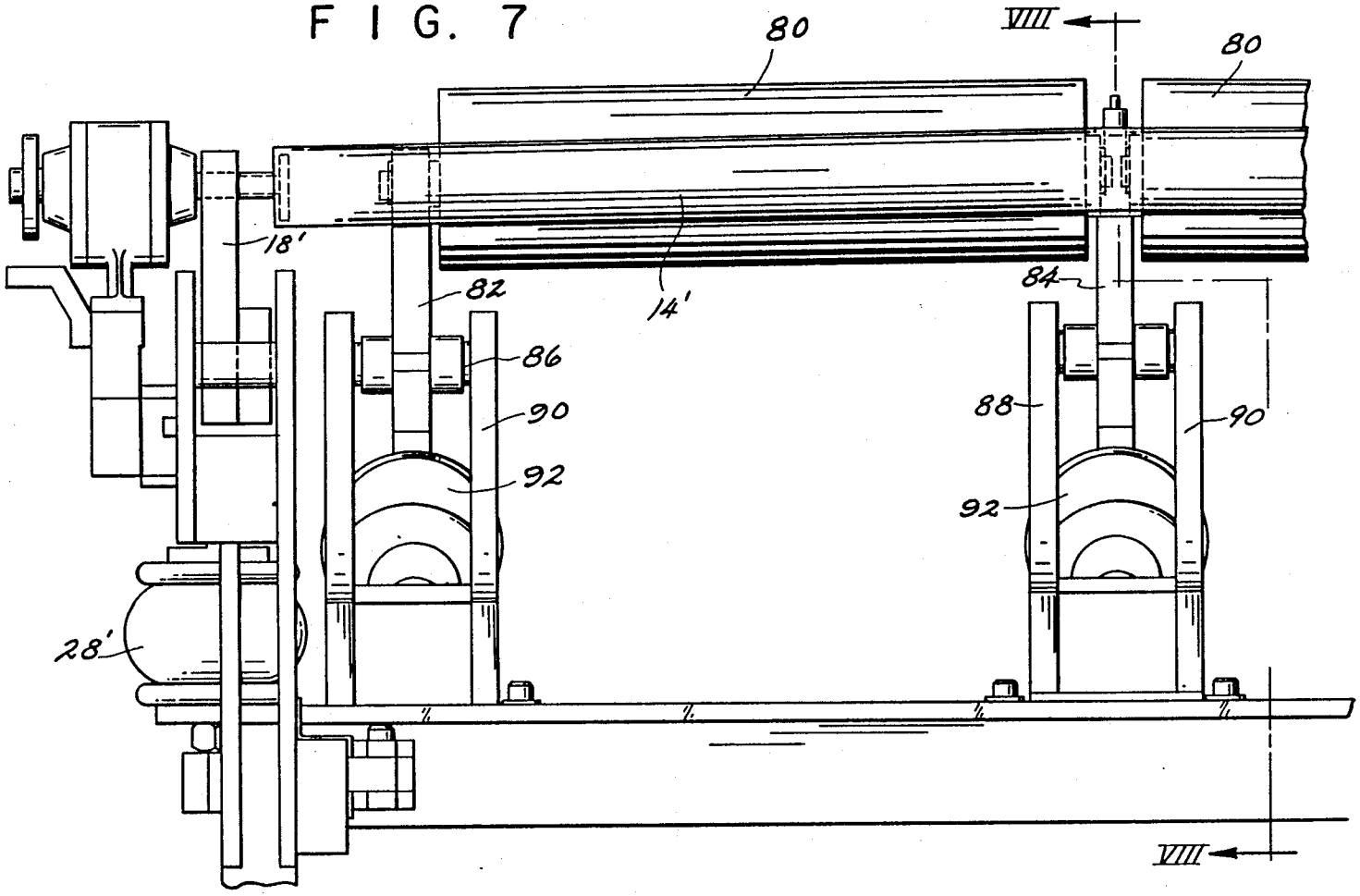
Figure 8:
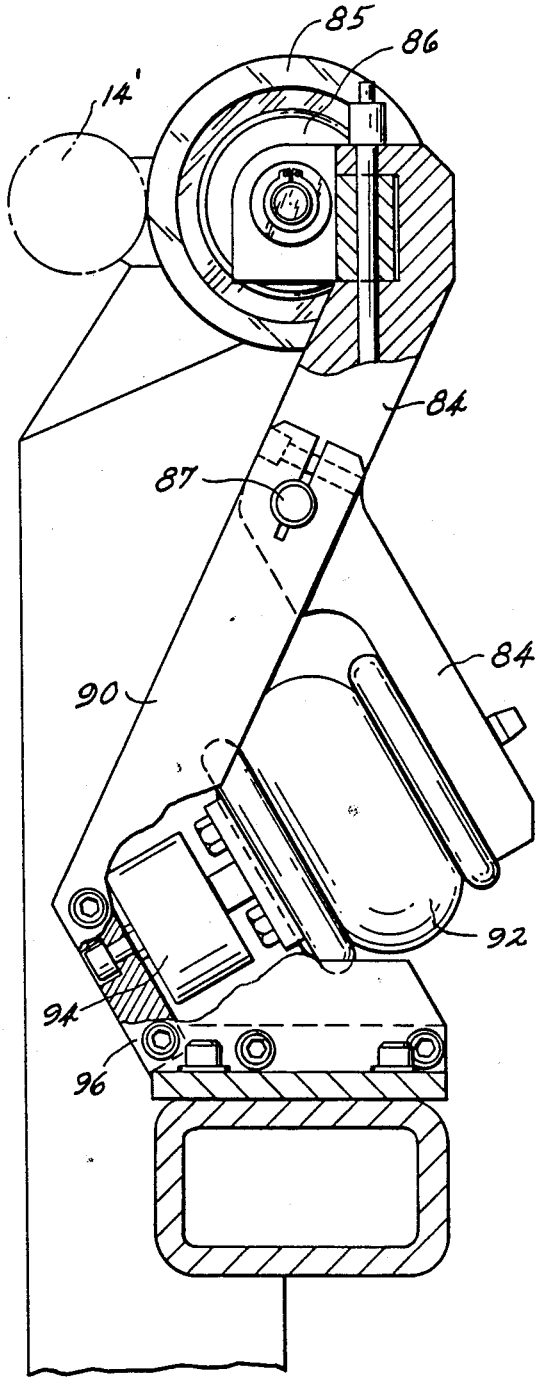
FIG. 8 is a sectional view taken on line VIII—VIII in FIG. 7.

The modification shown in FIGS. 6–8 has a smaller BLOR 14' which is mounted between bell-cranks 16', 18' and is pressed against the winding roll in much the same manner as the BLOR 14 shown in FIGS. 1–5. In addition, the modified apparatus includes a number of back-up rolls 80, each having a shaft fixed at its ends to the tops of outer and intermediate bell-cranks 82, 84 or two intermediate bell-cranks 84. Each back-up roll 80 has an aluminum shell 85 (FIG. 8) with a hard coat, anodized surface. The shell 85 rotates on internal ball bearings 86 supported by the non-rotating shaft. Each bell-crank 82, 84 is pivotally mounted at 87 between spaced stanchions 88, 90. Back-up rolls 80 are pressed against BLOR 14' by air springs 82 which, with load cells 94, are mounted between bell-cranks 84 and a base plate 96.

The provision of one or more back-up rolls permits the use of smaller bowed rolls and also prevents deflection of the BLOR as a roll is wound. Initially, the bow plane is set at the desired angle before clamping one end of the bowed shaft in the mounting block 64'. Thus, in this embodiment, there is no need for the toe-in adjustment illustrated in FIG. 5.

What is claimed as new and desired to be secured by Letters Patent is:

1. A film-winding apparatus comprising a driven winding roll to which a film is advanced, a segmented bowed lay-on roll, a linearly movable mount for the bowed roll and motive means coupled to the mount for moving the bowed lay-on roll into engagement with the winding roll beyond the point of tangency between the film and the winding roll and pressing it against wound film on the winding roll, said bowed roll being a follower.

2. The apparatus of claim 1 wherein said mount further comprises spaced blocks, said bowed roll is supported by the blocks and a device is provided on one of said blocks for adjusting orientation of the bow with respect to the winding roll.

3. The apparatus of claim 2 wherein said mount includes spaced reciprocatable carriages, an upstanding pedestal on each carriage, a bell-crank pivotally attached intermediate its ends to each pedestal and loading means attached to one end of each bell-crank, said blocks each being attached to the other end of a bell crank.

4. The apparatus of claim 1 further comprising at least one additional roll backing up the bowed roll, said back-up roll having associated therewith loading means for holding it against the bowed roll, said back-up also being a follower.

* * * * *